US006885842B2

(12) United States Patent
Sawai

(10) Patent No.: US 6,885,842 B2
(45) **Date of Patent: *Apr. 26, 2005**

(54) IMAGE FORMING APPARATUS WITH PHOTOCONDUCTIVE ELEMENT AND INTERMEDIATE IMAGE TRANSFER MEMBER

(75) Inventor: Yuuji Sawai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/752,812

(22) Filed: Jan. 8, 2004

(65) Prior Publication Data

US 2004/0136757 A1 Jul. 15, 2004

Related U.S. Application Data

(63) Continuation of application No. 10/193,240, filed on Jul. 12, 2002, now Pat. No. 6,768,892.

(30) Foreign Application Priority Data

Jul. 13, 2001 (JP) ..... 2001-213179

(51) Int. Cl.[7] ..... G03G 15/01; G03G 15/16
(52) U.S. Cl. ..... 399/302; 399/101
(58) Field of Search ..... 399/302, 308, 399/297, 343, 345, 346, 350, 353, 101

(56) References Cited

U.S. PATENT DOCUMENTS

| | | | |
|---|---|---|---|
| 5,510,886 A | 4/1996 | Sugimoto et al. | |
| 5,890,044 A | 3/1999 | Yamashita et al. | |
| 6,507,724 B1 | 1/2003 | Tamura et al. | |
| 6,768,892 B1 * | 7/2004 | Sawai | 399/302 |

FOREIGN PATENT DOCUMENTS

| | | |
|---|---|---|
| EP | 1 014 218 | 6/2000 |
| JP | 61-124979 | 6/1986 |
| JP | 8-166755 | 6/1996 |
| JP | 10-232532 | 9/1998 |
| JP | 10239943 A | 9/1998 |
| JP | 11035185 A | 2/1999 |
| JP | 11-045011 | 2/1999 |
| JP | 11344904 A | 12/1999 |
| JP | 2000066487 A | 3/2000 |
| JP | 2000-131960 | 5/2000 |
| JP | 2000-155511 | 6/2000 |
| JP | 2000172119 A | 6/2000 |
| JP | 2000-310912 | 11/2000 |
| JP | 2001305871 A | 11/2001 |

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming apparatus includes plural image forming devices each including an image carrier, a charger and a developing device, which in conjunction produce a corresponding toner image on the image carrier. A primary image transferring device transfers the toner images from the image carriers to an intermediate image transfer body one above the other, thereby forming a composite toner image. A secondary image transferring device transfers the composite toner image from the intermediate image transfer body to a recording medium. The primary image transferring device includes the intermediate image transfer body including at least an elastic layer, a cleaning device cleaning the intermediate image transfer body, and a coating device coating a lubricant on the intermediate image transfer body. The charger is released from the image carrier substantially at the same time as the coating device is released from the intermediate image transfer body.

17 Claims, 4 Drawing Sheets

IMAGE FORMING APPARATUS WITH PHOTOCONDUCTIVE ELEMENT AND INTERMEDIATE IMAGE TRANSFER MEMBER

CROSS-REFERENCE TO RELATED APPLICATIONS

The present application is a continuation of U.S. application Ser. No. 10/193,240 filed on Jul. 12, 2002 now U.S. Pat. No. 6,768,892 which in turn claims priority to JP 2001-213179 filed on Jul. 13, 2001, the entire contents of each of which are hereby incorporated herein by reference.

BACKGROUND OF THE INVENTION

1. Field of the Invention

The present invention relates to a facsimile apparatus, printer or similar image forming apparatus and more particularly to an image forming apparatus of the type including a photoconductive element and an intermediate image transfer body having an elastic layer.

2. Description of the Background Art

A color image forming apparatus of the type including an intermediate image transfer body is conventional and forms a full-color image on a sheet or similar recording medium by the following procedure. A latent image is electrostatically formed on a photoconductive drum or similar image carrier and then developed by toner to become a toner image. The toner image is transferred to the intermediate image transfer body (primary image transfer). Such toner images of different colors are sequentially transferred to the intermediate image transfer body one above the other, completing a full-color image. Subsequently., the full-color image transferred from the intermediate transfer body to a sheet or recording medium (secondary image transfer).

A tandem, color image forming apparatus is a specific form of the color image forming apparatus of the type described and includes a plurality of photoconductive drums arranged side by side. In the tandem, image forming apparatus, an exclusive developing unit is assigned to each drum for forming a toner image on the drum in a particular color. The resulting toner images of different colors are sequentially transferred from the consecutive drums to an intermediate image transfer body one above the other, completing a full-color image. The intermediate transfer body is often implemented as an endless belt in order to reduce the size and cost of the apparatus. More specifically, a belt is advantageous over a drum, which is another specific form of the intermediate image transfer body, because it promotes free layout in the design aspect and saves at least a space corresponding to the volume of the drum.

In any case, the color image forming system using the intermediate image transfer body allows toner images of different colors to be brought into accurate register with each other, compared to a system of the type directly transferring toner images of different colors from a photoconductive drum to a sheet. Further, the system with the intermediate image transfer body effectively copes with defective image transfer and other problems ascribable to a difference in the property of a sheet.

For the secondary image transfer from the intermediate image transfer body to a sheet, use is made of, e.g., a bias roller positioned beneath the photoconductive drum. However, in a configuration that causes the bias roller to press the intermediate image transfer body, intense pressure locally acts at the secondary image transfer position and is apt to cause the center portion of,. e.g., a character to be lost. Let this defect be referred to as the omission of the center of a character hereinafter.

Further, for the transfer of full-color images, various kinds of sheets including thick sheets, thin sheets and sheets of Japanese paper are often used. On the other hand, the conventional intermediate image transfer body is formed of fluorocarbon resin, polycarbonate resin, polyimide resin or similar resin and therefore too hard to deform complementarily to a toner layer. Consequently, the intermediate image transfer body is apt to compress a toner layer and bring about the omission of the center of a character. Particularly, when a full-color image is to be formed on a sheet having a rough surface, e.g., a Japanese paper sheet or a sheet intentionally formed with irregularity, a clearance is apt to appear between the sheet and toner and render a halftone portion or a solid portion irregular. Should image transfer pressure be intensified in order to obviate the above clearance, the cohesion of toner would be promoted and would aggravate the omission of the center of a character while increasing the amount of toner to be left on the intermediate image transfer body.

A cleaning device for cleaning the intermediate image transfer body includes a cleaning blade selectively movable into or out of contact with the intermediate image transfer body. When the operation of the image forming apparatus ends, the cleaning blade is released from the intermediate image transfer body and elastically restores its original position. This sometimes brings about a problem that the position where the cleaning blade contacts the intermediate image transfer body is slightly shifted, causing toner previously gathered by the cleaning blade to remain on the intermediate image transfer body in the form of a stripe. Such a stripe appears in the next toner image as a stripe-like smear.

Technologies relating to the present invention are disclosed in, e.g., Japanese Patent Laid-Open Publication Nos. 11-45011, 2000-155511 and 2000-310912.

SUMMARY OF THE INVENTION

It is an object of the present invention to provide an image forming apparatus capable of reducing the omission of the center of a character without exerting an excessive stress on toner existing on an intermediate transfer body at the time of image transfer.

It is another object of the present invention to provide an image forming apparatus capable of protecting an image from a stripe-like smear even when a cleaning blade is shifted from an expected position.

An image forming apparatus of the present invention includes a plurality of image forming means each including an image carrier, a charger for uniformly charging the surface of said image carrier, and a developing device for developing a latent image formed on the charged surface of the image carrier with toner to thereby produce a corresponding toner image. A primary image transferring device transfers such toner images from the image carriers to an intermediate image transfer body one above the other, thereby completing a composite toner image. A secondary image transferring device transfers the composite toner image from the intermediate image transfer body to a recording medium. The primary image transferring device includes the intermediate image transfer body including at least an elastic layer, a cleaning unit for cleaning the intermediate image transfer body, and a coating member for coating a lubricant on the intermediate image transfer body.

BRIEF DESCRIPTION OF THE DRAWINGS.

The above and other objects, features and advantages of the present invention will become more apparent from the following detailed description taken with the accompanying drawings in which.

DESCRIPTION OF THE PREFERRED EMBODIMENT

Figure 1:
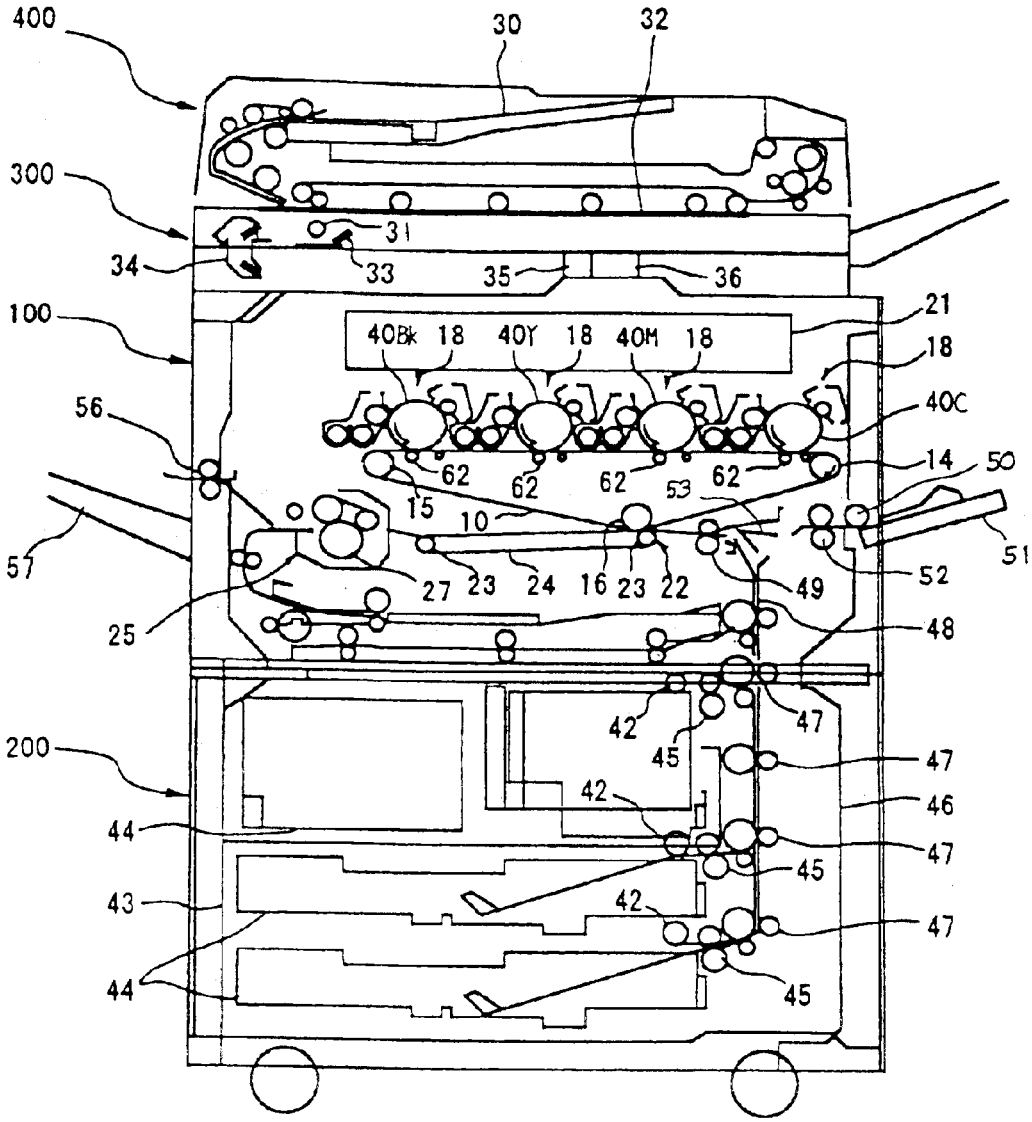
FIG. 1 is a view showing an image forming apparatus embodying the present invention.

Referring to FIG. 1 of the drawings, an image forming apparatus embodying the present invention is shown and implemented as a tandem, color image forming apparatus by way of example. As shown, the tandem, color image forming apparatus is generally made up of a scanning section 300, an image forming section 100 and a sheet feeding section 200 sequentially arranged from the top to the bottom in this order. An ADF (Automatic Document Feeder) 400 is mounted on the top of the scanning section 300. A controller, not shown, controls the operation of the entire image forming apparatus.

Assume that the operator of the apparatus selects a full-color mode and sets a desired document on a tray 30 included in the ADF 400 or sets it on a glass platen 32 included in the scanning section 300 by opening the ADF 400 and then closes the ADF 400. Then, when the operator presses a start button, not shown, the ADF 400 coveys the document from the tray 30 to the glass platen 32 if the document is laid on the tray 30. The controller drives the scanning section 300 as soon as the document arrives at the glass platen 32 or drives it immediately if the document is directly set on the glass platen 32. The scanning section 300 causes its first and second carriages 33 and 34 to move. A light source 31 mounted on the first carriage 33 illuminates the document positioned on the glass platen 32 and steers the resulting reflection from the document toward the second carriage 34. A mirror mounted on the second carriage 34 reflects the incident light toward an image sensor 36 via a lens 35. The image sensor 36 reads image data represented by the incident light.

An optical writing unit 21 included in the image forming section 100 performs laser writing in accordance with the image data output from the scanning section 300 as well as development, thereby forming toner images of different colors on photoconductive drums 40Bk (black), 40Y (yellow), 40M (magenta) and 40C (cyan). At the same time, one of four pickup rollers, which will be described later, is driven to feed a sheet of a size corresponding to the image data. Further, a drive motor, not shown, drives one of support rollers 14, 15 and 16 over which an intermediate image transfer belt (simply belt hereinafter) 10 is passed. The roller driven by the drive motor causes the belt 10 to move; the other rollers serve as driven rollers.

Figure 2:
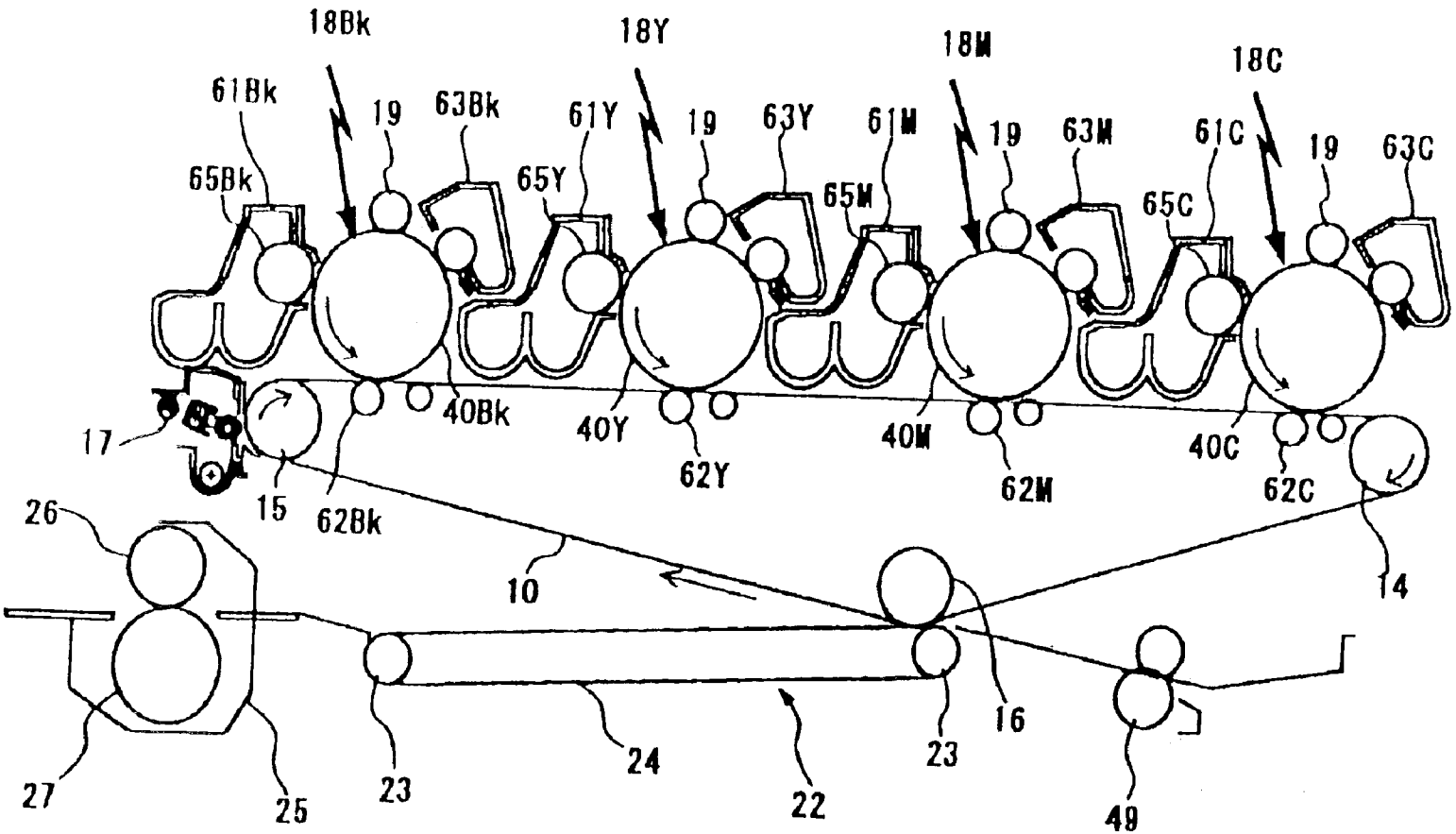
FIG. 2 is a view showing an intermediate image transfer body included in the illustrative embodiment together with arrangements surrounding it.

FIG. 2 shows the belt 10 and arrangements surrounding it in detail. As shown, image forming units 18Bk, 18Y, 18M and 18C include photoconductive drums 40Bk, 40Y, 40M and 40C, respectively. While the drums 40Bk, 40Y, 40M and 40C are in rotation, a black, a yellow, a magenta and a cyan toner image are respectively formed on the drums 40 Bk, 40Y, 40M and 40*c* at the same time. The black, yellow, magenta and cyan toner images are sequentially transferred to the belt 10, which is moving, one above the other to thereby complete a full-color image.

As shown in FIG. 1, in the sheet feeding section 200, one of pickup rollers 42 is rotated to pay out a sheet from a sheet cassette 44 associated therewith while a reverse roller 45 cooperative with the pickup roller separates the above sheet form the underlying sheets. The sheet paid out from the sheet cassette 44 is fed to a registration roller pair 49 via a path 48. Alternatively, when the operator sets a special sheet on a manual feed tray 51, a pickup roller 50 feeds the special sheet from the manual feed tray 51 to the registration roller pair 49 via a path 53.

The registration roller pair 49 once stops the sheet and then drives it toward a nip between the belt 10 and a secondary image transfer roller 23 such that the leading edge of the sheet meets the leading edge of the full-color image present on the belt 10. A preselected bias for secondary image transfer is applied to the secondary image transfer roller 23, forming an electric field for image transfer at the nip. As a result, the full-color image is transferred to the sheet by the electric field and contact pressure. A belt conveyor 24 conveys the sheet carrying the full-color image thereon to a fixing unit 25. The fixing unit 25 fixes the full-color image on the sheet with heat and pressure. The sheet or print coming out of the fixing unit 25 is driven out to a print tray 57 by an outlet roller pair 56.

Secondary image transferring means 22 is positioned below the belt 10 and includes the belt or secondary image transfer body 24 passed over two rollers 23. The belt 24 is pressed against the support roller or third support roller 16 via the belt 10, forming a nip for secondary image transfer. The full-color image is transferred from the belt 10 to the sheet at the above nip. After the secondary image transfer, cleaning means 17 removes the toner left on the belt 10 to thereby prepare it for the next image forming cycle.

Figure 4:
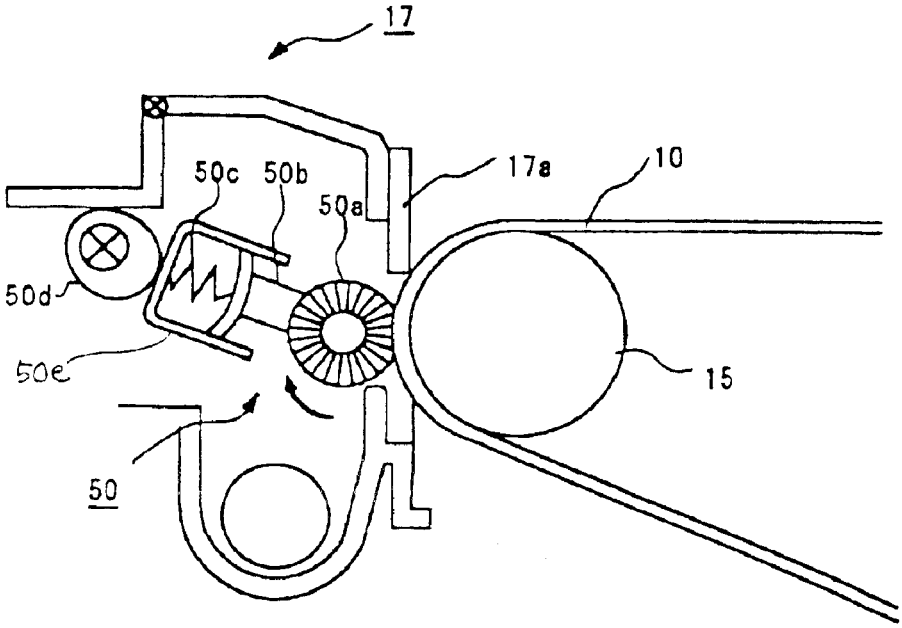
FIG. 4 is a fragmentary view showing a cleaning device included in the illustrative embodiment for cleaning the intermediate image transfer body.

As shown in FIG. 4 specifically, the cleaning means 17 includes a cleaning blade or cleaning member 17*a* formed of elastic rubber, which should preferably be urethane resin or isoprene rubber. The cleaning blade 17*a* may contact the belt 10 in either one of a counter position and a trailing position. The cleaning blade should preferably contact the belt 10 at a position where any one of the support rollers exists in order to prevent the belt 10 from deforming. The toner removed from the belt 10 by the cleaning blade 17*a* is collected in a tank not shown.

Figure 3:
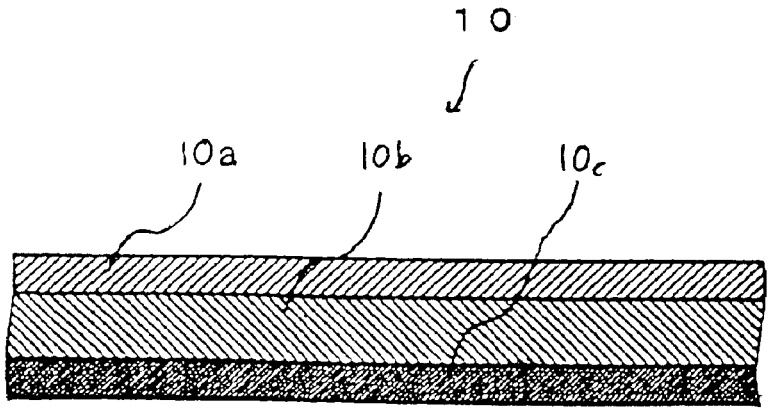
FIG. 3 is a fragmentary section showing the structure of the intermediate image transfer body.

A specific configuration of the belt or intermediate image transfer body 10 will be described with reference to FIG. 3. As shown, the belt 10 is a laminate including at least a base layer 10*a*, an elastic layer 10*b* with low hardness, and a coat layer or surface layer 10*c*. The elastic layer 10*b* allows the belt 10 to deform complementarily to a toner layer or a sheet with low smoothness at the image transfer nip. Because the surface of the belt 10 is deformable complementarily to local irregularity, the belt 10 can closely contact a toner layer without excessively compressing it for thereby obviating the omission of the center of a character freeing, e.g., a solid image portion from irregularity even on a rough sheet.

The elastic layer 10*b* maybe formed of elastic rubber, elastomer or similar elastic material. More specifically, use may be made of one or more of butyl rubber, fluororubber, acrylic elastomer, EPDM, NBR, acrylonitrile-butadien-styrene rubber, natural rubber, isoprene rubber, styrene-butadiene rubber, butadiene rubber, urethane rubber, syndiotactic 1,2-polybutadiene, epichlorohydrine rubber, polysulfide rubber, and thermoplastic elastomer, e.g., polystyrene resin, polyvinyl chloride resin, polyurethane resin, polyamide resin, polyurea resin, polyester resin or fluorocarbon resin.

The elastic layer 10*b* should preferably be 0.07 mm to 0.3 mm thick although it depends on the hardness and laminate structure of the belt 10. If the elastic layer 10*b* is thicker than 0.3 mm, then the belt 10 is deformed by the cleaning blade 17*a* or causes the cleaning blade 17*a* to bite into the belt 10 and obstruct the smooth movement of the belt 10. If the elastic layer 10*b* is thinner than 0.07 mm, then the pressure of the belt 10 acting on toner at the secondary image transfer nip to increase and is apt to bring about the omission of the center of a character and lower the transfer ratio of toner.

The hardness of the elastic layer 10*b* should preferably be $10° \leqq HS \leqq 650°$ in JIS A scale. Hardness lower than 10° is apt to bring about the omission of the center of a character although the optimal hardness depends on the thickness of the belt 10. Hardness higher than 650° makes it difficult for the belt 10 to be passed over rollers and causes the belt 10 to stretch in a long time, lowering the durability of the belt 10.

The base layer 10*a* of the belt 10 is formed of resin that stretches little. For example, the base layer 10*a* may be formed of one or more of polycarbonate, fluorocarbon resin (e.g. ETFE or PVDF), polystyrene, chloropolystyrene, poly-α-methylstyrene, styrene-budadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyle acrylate copolymer or styrene-phenyl acrylate copolymer), styrene-methacrylate copolymer (e.g. styrene-methyl methacrylate, styrene-ethyl methacrylate copolymer or styrene-phenyl methacrylate copolymer), styrene-α-methyl chloroacrylate copolymer, styrene-acrylonitrile-acrylate copolymer or similar styrene resin (e.g. polymer or copolymer containing styrene or substituted styrene), methyl methacrylate resin, butyl methacrylate resin, ethyl acrylate resin, butyl acrylate resin, modified acrylic resin (silicone modified acrylic resin, vinyl chloride resin modulated acrylic resin or acryl-urethane resin), vinyl chloride resin, styrene-vinyl acetate resin copolymer, vinyl chloride-vinyl acetate copolymer, rosin modulated maleic ester resin, phenol resin, epoxy resin, polyester resin, polyester-polyurethane resin, polyethylene, polypropylene, polybudadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin.

The base layer 10*a* may be implemented as a core layer formed of, e.g., canvas that prevents stretching, in which case the elastic layer 10*b* will be formed on the core layer. The material that prevents stretching may be implemented by one or more of natural fibers including cotton and silk, synthetic fibers including polyester fibers, nylon fibers, acrylic fibers, polyorefine fibers, polyvinyl alcohol fibers, polyvinyl chloride fibers, polyvinylidene chloride fibers, polyurethane fibers, polyacetal fibers, polyfluoroethylene fibers and phenol fibers, inorganic fibers including carbon fibers and glass fibers, and metal fibers including iron fibers and copper fibers. The fibers may be configured as threads or textile and may be twisted in any suitable manner. Of course, the threads may be processed to have electric conduction. Textile may be woven in any suitable manner, e.g., tockinette and may be provided with electric conduction.

The coat layer 10*a* coating the surface of the elastic layer 10*b* is formed of, e.g., fluorocarbon resin and has a smooth surface. While the material of the coat layer 10*a* is open to choice, it is generally implemented as a material that reduces the adhesion of toner to the surface of the belt 10 for thereby enhancing accurate secondary image transfer. For example, use may be made of one or more of polyurethane resin, polyester resin, epoxy resin and other resins. Alternatively, use may be made of a material that reduces surface energy to thereby enhance lubrication, e.g., one or more of fluorocarbon resin grains, fluorine compound grains, carbon fluoride grains, titanium oxide grains and silicon carbide grains with or without the grain size being varied. Further, fluororubber may be heated to form a fluorine layer on the surface, so that surface energy is reduced.

To adjust resistance, the base layer 10*a*, elastic layer 10*b* and coat layer 10*c* each maybe formed of the powder of carbon black, graphite, aluminum, nickel or similar metal or tin oxide, titanium oxide, indium oxide, potassium titanate, ATO (antimony oxide-tin oxide), ITO (indium oxide-tin oxide) or similar conductive metal oxide. The conductive metal oxide may be coated with insulative fine grains of, e.g., barium sulfate, magnesium silicate or calcium carbonate.

As shown in FIG. 4, the illustrative embodiment further includes coating means 50 for coating a lubricant 50*b* on the belt 10. The coating means 50 includes a brush 50*a* held in contact with the belt 10 for coating the lubricant 50*b* on the belt 10. A spring 50*c* supports the lubricant 50*b* while pressing it against the brush 50*a* with preselected pressure. The spring 50*c* is seated on a cover 50*e*. When the brush 50*a* is rotated, it shaves off the lubricant 50*c* little by little and coats it on the surface of the belt 10.

The coating means 50 may additionally include control means for controlling the condition in which the brush 50*a* and lubricant 50*b* contact each other. The spring 50*c* biases the lubricant 50*b* against the brush 50*a* such that a preselected stress acts on the brush 50*a*. Releasing means 50*d* may be held in contact with the cover 50*e*, which accommodates the spring 50*c*, and moved in accordance with the number of prints output or the duration of drive of the apparatus, thereby controlling the contact of the brush 50*a* and lubricant 50*b*.

An anti-scattering member 17*a* is positioned downstream of the coating means 50 in the direction of movement of the belt 10. The coating means 50 shaves off the lubricant 50*b* with the brush 50*a* and feeds it to the belt 10 in the form of fine grains, as stated above. The anti-scattering member 17*a* prevents part of such grains not deposited on the belt 10 from being scattered around in the apparatus.

The anti-scattering member 17*a* should preferably play the role of a cleaning blade for cleaning the belt 10 at the same time. This successfully reduces the number of parts and cost and facilitates design. As for part of the lubricant 50*b* stopped by the anti-scattering member or cleaning blade 17*a* and deposited on the belt 10, the force of the cleaning blade 17*a* acting on the belt 10 causes, e.g., zinc stearate to cleave and form a thin film on the belt 10. In the case of PEFE grains, for example, the above force of the cleaning blade 17*a* causes them to firmly adhere to the coat layer 10*a* and form irregularity on the surface of the belt 10. In any case, adhesion acting between toner and the belt 10 is reduced to obviate the omission of the center of a character and other defects and to increase the transfer ratio.

As for the lubricant 50*b*, use may be made of any suitable material, e.g., PTFE. PVDF or similar fluorine-contained resin, silicone resin, polyorefine resin, paraffin wax, stearic acid resin, lauric acid resin, palmitic acid resin or similar fatty acid metal salt, graphite or molybdenum disulfide. As for a fatty acid metal salt, stearic acid metal salt is preferable. As for resin powder, fluorocarbon resin powder is preferable.

Stearic acid metal salt is a compound of stearic acid and aluminum, barium, magnesium, iron or the like. Many of such compounds cleave, i.e., each cleaves to form a thin film when subjected to a pressure. For example, the cleaved compound forms a thin film on the surface of the belt 10 to which it is applied, reducing adhesion acting between the belt 10 and toner. Zinc stearate is particularly desirable because it easily cleaves.

Fluorocarbon resin is usable as a lubricant because cohesion energy between molecules is low, because structurally the surfaces of molecule chains are smooth, and because frictional resistance is lowered due to orientation, i.e., it has a small coefficient of surface friction. Fluorocarbon is a synthetic high polymer containing fluorine atoms in a molecule and usually refers to nine different substances: polytetrafluoroethylene (PTFE), tetrafluoroethylene-perfluoroalkylvinylether copolymer (PFA), tetrafluoroethylene-hexafluoropropylene copolymer (FEP), tetrafluoroethylene-ethylene copolymer (E/TFE), polyvinylidene fluoride (PVDF), polychlorotrifluoroethylene (PCTFE), tetrafluoroethylene-perfluorodimethyldioxol copolymer (TFE/PDD), and polyvinylfluoride (PVF).

The lubricant 50*b* coated on the belt 10 reduces adhesion acting between the belt 10 and a toner image transferred thereto and thereby obviates the omission of the center of a character and other defects.

As shown in FIG. 2, a charger 19 is assigned to each of the drums 18Bk through 18C and implemented as a charge roller. A power supply, not shown, applies a voltage to the charge roller 19 on a constant current control basis. The charger 19 is made up of a core formed of stainless steel and an ion-conductive rubber layer formed or, the core. The rubber layer has resistance ranging from $10^4$ Ω to $10^6$ Ω and has rubber hardness that is preferably 40° or above, more preferably 70° or above, in JIS A scale.

The rubber layer of the charger 19 may be replaced with a layer of, e.g., elastomer or resin so long as it is as hard as rubber. Resin, for example, is not elastic and allows a gap to be accurately maintained, i.e., causes a minimum of irregularity to occur in the gap between the charge roller 19 and the drum 40 in the axial direction. A surface layer having resistance of about $10^{10}$ Ω or above covers the charge roller 19 in order to prevent, when pin holes or similar low-resistance portions exist in the drum 40, a current from concentratedly flowing therethrough.

First releasing means releases the charge roller 19 from the associated drum 40 substantially at the same time as the coating means 50, i.e., the brush 50*a* thereof is released from the belt 10. This prevents the lubricant 50*b* coated on the belt 10 from being transferred to the charge roller 19 via the drum 40. The first releasing means may be implemented by, e.g., a solenoid or a cam configured to lift the charge roller 19. When use is made of a solenoid, which is preferable, bearings supporting the charge roller 19 should preferably be lifted together with the charge roller 19; the charge roller 19 and power supply should preferably be connected by a brush-like contact.

The lubricant 50*b* deposited on the belt 10 directly contacts the drums 40 at the consecutive, primary image transfer positions. At this instant, the lubricant 50*b* is transferred from the belt 10 to each drum 40 due to a stress ascribable to a difference in pressure or rotation speed between rollers including an image transfer roller 62. This part of the lubricant 50*b* does not accumulate on the drum 40 because the amount of transfer is small and because a drum cleaner 63 is associated with the drum 40. However, the lubricant 50*b* is transferred to the charge roller 19 via the drum 40. The charge roller 19 is too small in size to be provided with an exclusive cleaning blade or similar cleaning member. It follows that if the lubricant 50*b* is irregularly transferred to the charge roller 19, it makes the charge potential on the surface of the drum 40 irregular. Should an image be formed in such a condition, a halftone portion transferred to a sheet would appear irregular.

Particularly, in the tandem, color image forming apparatus, the belt 10 sequentially contacts the consecutive drums 40, so that the lubricant 50*b* is transferred to the first drum 40 in a great amount, but is transferred to the last drum 40 in a small amount. As a result, the amount of the lubricant 50*b* differs from one charge roller 19 to another charge roller 19, causing irregularity to occur in a halftone portion formed by each image forming unit in a particular manner. This obstructs the faithful reproduction of the halftone of a color image. This is why the illustrative embodiment releases the charge rollers 19 from the associated drums 40.

The releasing means 50*d* mentioned earlier constitutes second releasing means for releasing the cleaning blade 17*a* from the belt 10. While the second releasing means 50*d* may have any suitable configuration, it may be implemented by a solenoid or a cam by way of example. More specifically, if the elastic cleaning blade 17*a* is constantly held in contact with the belt 10, then a stress constantly acts on the cleaning blade 17*a* and causes it to deform to such a degree that the original position cannot be restored. This lowers the pressure acting between the cleaning blade 17*a* and the belt 10 to thereby make belt cleaning defective. Further, when the apparatus is out of operation, the cleaning blade 17*a* constantly pressing the belt 10 causes the elastic layer 12 of the belt 10 to deform in the form of a hollow. The hollow makes the transfer of a toner image from the drum 40 defective. Moreover, if the cleaning blade 17*a* is caught by such a hollow of the belt 10 during repeated image formation, then a shock is apt to act on the belt 10 and sharply vary the moving speed of the belt 10. In light of this, the second releasing means 50*d* releases the cleaning blade 17*a* from the belt 10 for thereby obviating defective cleaning.

The cleaning blade 17*a* should preferably be released from the belt 10 substantially at the same time as the brush 50*a* is released from the belt 10. More preferably, the brush 50*a* should be released from the belt 10 before the cleaning blade 17*a*, so that the lubricant 50*b* is not scattered around in the apparatus.

Figure 5A:
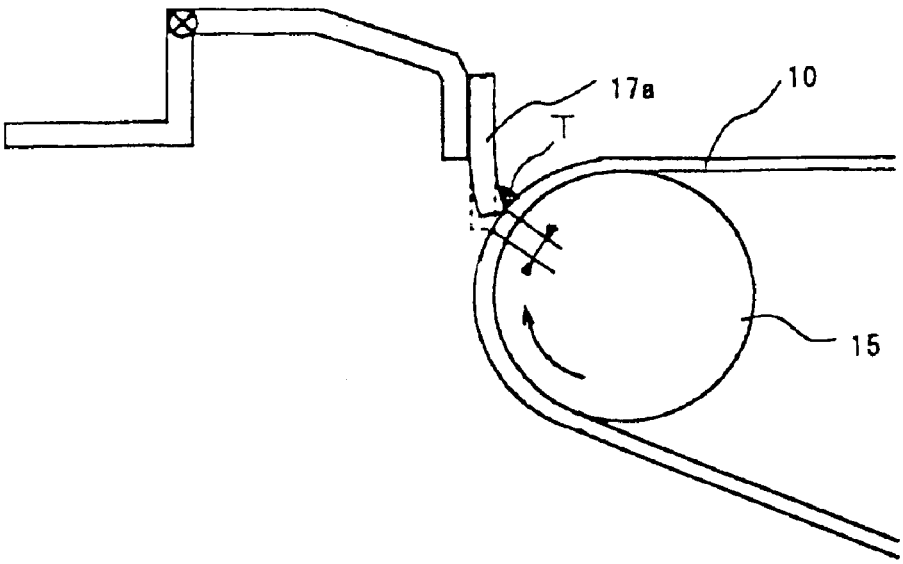
FIGS. 5A and 5B are fragmentary views demonstrating how the intermediate image transfer body is moved in the reverse direction for protecting an image from a smear.

When the cleaning blade 17*a* is released from the belt 10 at the end of image forming operation of the apparatus, the belt 10 is moved in the reverse direction and then stopped in order to protect an image from a smear. More specifically, when the cleaning blade 17*a* is released from the belt 10, it elastically restores its original position. As a result, when the cleaning blade 17*a* is again brought into contact with the belt 10 at the beginning of the next image forming operation, the contact position is slightly shifted from the previous contact position because the cleaning blade 17*a* has restored its original position. Consequently, as shown in FIG. 5A, toner previously gathered by the cleaning blade 17*a* remains on the belt 10 in the form of a stripe and appears on the next image as a smear.

Figure 5B:
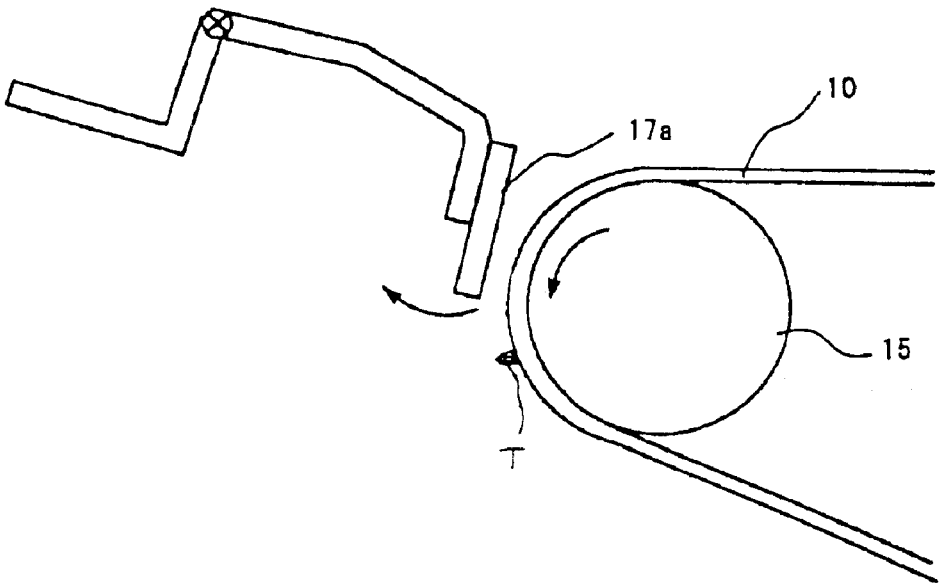

In the illustrative embodiment, as shown in FIG. 5B, when the cleaning blade 17*a* is released from the belt 10, the belt 10 is slightly moved in the reverse direction to thereby return the stripe-like toner left on the belt 10 to a position upstream of the cleaning blade 17*a*. This successfully protects the next image from a stripe-like smear ascribable to the above toner.

In summary, it will be seen that the present invention provides an image forming apparatus capable of improving the transfer ratio of toner from an intermediate image transfer body to a sheet to thereby obviate the omission of the center of an image and other defects. Further, the apparatus of the present invention obviates the shift of the intermediate image transfer body that would cause a stripe-like smear to appear on an image.

Various modifications will become possible for those skilled in the art after receiving the teachings of the present disclosure without departing from the scope thereof.

What is claimed is:

1. An image forming apparatus comprising:

a plurality of image forming devices each comprising an image carrier, a charger configured to uniformly charge a surface of said image carrier, and a developer configured to develop a latent image formed on the charged surface of said image carrier with toner to thereby produce a corresponding toner image;

a primary image transferring device configured to transfer toner images from image carriers of said plurality of image forming devices to an intermediate image transfer body one above the other, thereby completing a composite toner image; and a secondary image transfer device configured to transfer the composite toner image from said intermediate image transfer body to a recording medium;

said primary image transfer device comprising:

said intermediate image transfer body including at least an elastic layer;

a cleaning device configured to clean said intermediate image transfer body; and a coating device configured to coat a lubricant on said intermediate image transfer body, wherein said charger is released from said image carrier substantially at the same time as said coating device is released from said intermediate image transfer body.

2. The apparatus as claimed in claim 1, wherein said elastic layer of said intermediate image transfer body is 0.07 mm to 0.3 mm thick.

3. The apparatus as claimed in claim 2, wherein said coating device comprises a rotary brush.

4. The apparatus as claimed in claim 3, wherein said coating device further comprising a control configured to control a condition in which said brush and the lubricant contact each other.

5. The apparatus as claimed in claim 4, wherein said image forming devices comprise an anti-scattering member positioned downstream of said coating device in a direction of movement of said intermediate image transfer body for preventing the lubricant from being scattered around.

6. The apparatus as claimed in claim 5, wherein said anti-scattering member plays the role of a cleaning blade included in said cleaning device at the same time.

7. The apparatus as claimed in claim 6, wherein said charger comprises a charge roller.

8. The apparatus as claimed in claim 1, wherein said coating device is released from said intermediate image transfer body, and then said cleaning device is released from said intermediate image transfer body.

9. The apparatus as claimed in claim 8, further comprising a releasing device configured to release said coating device and said cleaning device from said intermediate image transfer body substantially at the same time.

10. The apparatus as claimed in claim 9, wherein said releasing device comprises a cam.

11. The apparatus as claimed in claim 10, wherein when said apparatus ends an image forming operation, said cleaning device is released from said intermediate image transfer body, and said intermediate image transfer body is moved in a reverse direction and then stopped.

12. The apparatus as claimed in claim 1, wherein said coating device comprises a rotary brush.

13. The apparatus as claimed in claim 12, wherein said coating device further comprising a control configured to control a condition in which said brush and the lubricant contact each other.

14. The apparatus as claimed in claim 13, wherein said image forming devices comprise an anti-scattering member positioned downstream of said coating device in a direction of movement of said intermediate image transfer body for preventing the lubricant from being scattered around.

15. The apparatus as claimed in claim 14, wherein said anti-scattering member plays the role of a cleaning blade included in said cleaning device at the same time.

16. The apparatus as claimed in claim 15, wherein said charger comprises a charge roller.

17. The apparatus as claimed in claim 1, wherein said charger comprises a charge roller.

* * * * *